US005491314A

United States Patent [19]

Dorsey

[11] Patent Number: 5,491,314

[45] Date of Patent: Feb. 13, 1996

[54] FLAT HIGH TEMPERATURE MEMBRANE SWITCH DISPLAY WINDOW

[75] Inventor: Paul S. Dorsey, Concord Township, Champaign County, Ohio

[73] Assignee: Whirlpool Corporation, Benton Harbor, Mich.

[21] Appl. No.: 289,262

[22] Filed: Aug. 11, 1994

[51] Int. Cl.[6] ..... H01H 9/00

[52] U.S. Cl. ..... 200/313; 200/310; 200/308; 345/173; 345/176

[58] Field of Search ..... 200/512, 308, 200/310, 311, 312, 313, 314, 315, 316, 317; 116/279; 341/34, 35; 345/173, 176

[56] References Cited

U.S. PATENT DOCUMENTS 3,334,209 8/1967 Hill et al. ..... 200/314
4,318,958 3/1982 Piatt ..... 200/313
4,454,501 6/1984 Butts .
4,611,261 9/1986 Suwa .
4,901,074 2/1990 Sinn et al. .
5,138,137 8/1992 Holling et al. .

*Primary Examiner*—William A. Cuchlinski, Jr.
*Assistant Examiner*—David J. Walczak
*Attorney, Agent, or Firm*—Hill, Steadman & Simpson

[57] ABSTRACT

A flat, high temperature membrane switch display having a display, a rigid substructure with a hole approximately of the dimensions of the display located approximately in its center, multiple switch layers with a hole approximately of the dimensions of the display located approximately in its center, an overlay with a display window approximately of the dimensions of the display located approximately in its center, and a clear part affixed to the overlay by an adhesive.

17 Claims, 1 Drawing Sheet

FLAT HIGH TEMPERATURE MEMBRANE SWITCH DISPLAY WINDOW

BACKGROUND OF THE INVENTION

The present invention relates to membrane switches and more particularly to a flat high temperature membrane switch display window for use in association with appliances, such as electric ranges.

Several types of appliances, such as ranges, cooktops and the like have control panels and membrane switches with electronic displays. These membrane switches and displays have become popular in many later model units. However, problems arise because of the cooktop environment and the elevated temperatures associated therewith. Thus, the control panel on the appliance experiences heating at levels above ambient room temperature.

Currently, membrane switches and displays are made by adhering multiple layers of thin plastic together and then bonding that assembly to a rigid substructure. In applications where some type of display is mounted behind the switch assembly, it is common practice to put a hole in the substructure and in all the switch layers except the outermost layer (the overlay layer). The overlay layer is the layer the user sees, and it forms a smooth, easily cleaned surface. The display is viewed through a transparent area of the overlay (a display window). The display window is not adhered to anything because all of the adhesives currently available will over time become cloudy and obstruct the view of the display.

The common overlay materials, for example, polyester and polycarbonate, are heat sensitive and cause distortion of the display window at relatively low temperatures on many cooking appliances. This problem relates to the "perceived quality" of the appliance. The user finds this distortion unappealing and unacceptable in practice. Thus, it is apparent that maintaining fiat display windows on appliances, such as open door boilers, in vent areas and in areas with two rear burners on a free standing range is a constant design problem requiting additional tests, design time and money.

In the past, the portion of the overlay of the membrane switch covering the display consisted of a single layer of transparent, flexible material. The overlay thus contained a volume of air in the space between it and the display. When this volume of air becomes heated due to increased cooktop of oven temperatures, the volume of air expands, and the overlay softens from the heat. Thus, when exposed to the heat, the overlay distorts as a result of the pressure of the increased volume of heated air. Thus, the membrane would no longer have an attractive flat appearance; it would bubble and appear uneven making the display illegible.

U.S. Pat. No. 4,611,261 relates to an electronic calculator which has a membrane overlay covering the keypad and display. Also, beneath a membrane in the display area is a rigid polarizing plate that is not fastened to the membrane. Thus, no means for fastening the plate to the membrane is provided in this device.

U.S. Pat. No. 4,901,074 relates to a membrane switch on a cooking appliance. A layer of glass is provided on the outside of the control keypad and the display to resist heat.

SUMMARY OF THE INVENTION

The present invention provides an effective solution to prevent distortion and rippling of a membrane switch on the control panel of a cooktop, range or other environment having excessive heat. The present invention has a thin, rigid, clear glass or plastic part attached immediately inside the layer of transparent and flexible material coveting the display, i.e., the overlay. The clear pan is secured only at its peripheral edges to the flexible overlay by an adhesive. This results in an infinitesimal volume of air between the overlay and the clear part which greatly reduces distortion of the flexible overlay. For example, the volume of air, which is greatly reduced from that of prior art devices, cannot possibly expand as much, thereby greatly reducing any overlay distortion due to an expanding volume of heated air behind the overlay.

Thus, a clear plastic or glass pan is adhered to the back side of the overlay. The adhesive (applied either to the clear part or to the overlay) is only applied to the outer periphery of the clear part. This inventive design provides at least two advantages. The first advantage provided by the present invention is that the adhesive contact area around the edge of the clear part is not visible to the user, thus, the clarity of the display window is not degraded.

The second advantage of applying the adhesive only on the outer edge of the clear pan is that the clear pan then forms an air tight seal in the display window area of the overlay. The adhered edges of the clear part form an approximately air tight seal with the overlay. When heat tries to distort the overlay in the display window, the overlay is confined by atmospheric pressure pressing on the outside of the overlay which overcomes any reduced pressure in the sealed volume that would be formed while the heat attempts to blister the overlay. The configuration of the invention overcomes the slight forces of the overlay material when it tries to deform, causing it to remain flat or distort very little.

The objects of the present invention are inventively achieved in a flat high temperature membrane switch display window having a display, a rigid substructure with a center hole, multiple switch layers with center holes, an overlay having a display window located approximately in its center, and a clear part affixed at its peripheral edges to the overlay by an adhesive.

DESCRIPTION OF THE PREFERRED EMBODIMENTS

Figure 1:
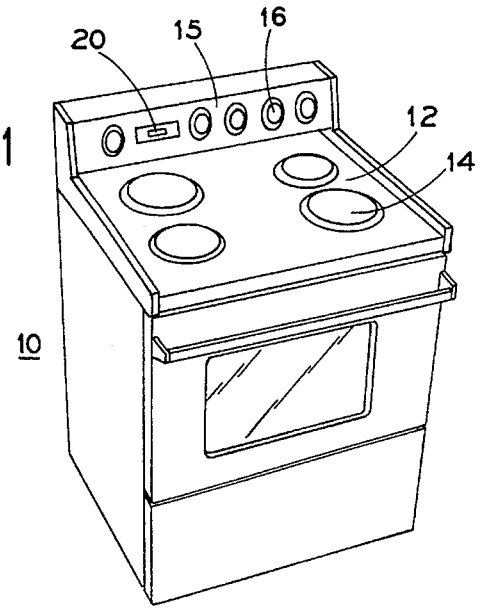
FIG. 1 is a perspective view of an appliance illustrating a range having a control panel on which a fiat high temperature membrane switch display window embodying the principles of the present invention could be utilized.

FIG. 1 illustrates an appliance generally at 10 which shows a range. However, the present invention can be used with other types of appliances, such as stand-alone cooktops, hot plates, dishwashers and other items with control panels in environments susceptible to increased heat.

The range 10 has a cooktop surface 12 having a plurality of burners 14 and a control panel 15. On the control panel 15 are control knobs 16 and a flat, high temperature membrane switch display 20. The burners 14 are controlled by the control knobs 16 positioned on the control panel 15. The flat, high temperature membrane switch display 20 is provided for various display and control functions on the range 10.

Figure 2:
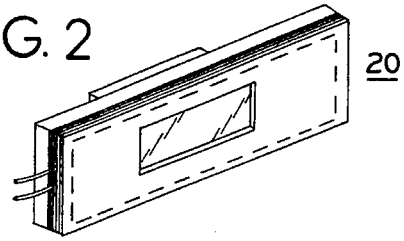
FIG. 2 is a perspective view of the present invention.
Figure 3:
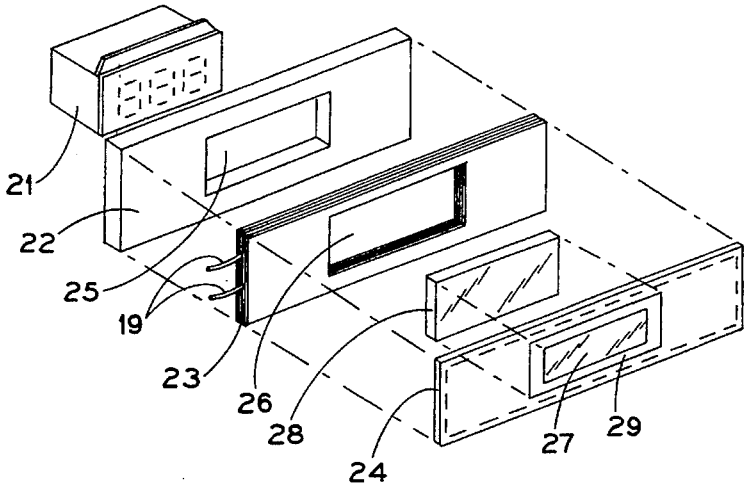
FIG. 3 is an exploded perspective view of the present invention.

FIG. 2 illustrates a flat high temperature membrane switch display of the present invention. The membrane switch display 20 has several components. As illustrated in an exploded perspective view of the membrane switch display 20 in FIG. 3, these components include a display 21, a rigid substructure 22 having a center hole 25 having the approximate dimensions of the display 21, multiple switch layers 23, each having a center hole 26 having the approximate dimensions of the display 21, a rigid or semi-rigid clear part 28, an overlay 24 having a hole or a clear display window 27. In an embodiment of the present invention, the clear part 28 may have the shape of a cube. As mentioned above, the center holes 25 and 26 have the approximate dimensions of the face of the display 21 to allow the user to view the display 21. Also, the multiple switch layers 23 have electrical contacts 19 for connecting to other components of the appliance 10.

Figure 4:
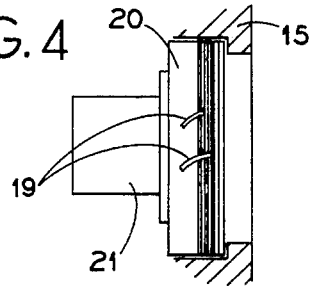
FIG. 4 is a side view of the present invention mounted in an appliance.

Further, FIG. 4 shows a side view of an embodiment of the membrane switch display 20 having the display 21 mounted behind the control panel 15 of the appliance 10. The electrical contacts 19 are illustrated in an unconnected manner.

Figure 5:
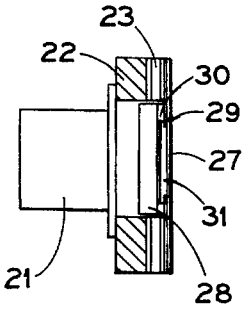
FIG. 5 is a side section view of the present invention under no heat or low heat conditions.

FIG. 5 illustrates a side section view of the membrane switch display 20 under a no heat or a low heat condition. An adhesive layer 30 applied to the periphery of the clear part 28 is illustrated. The adhesive layer 30 is preferably heat resistive so that it performs more effectively in the environment of an oven. As illustrated, the display window 27 area remains flat since the heat level is zero or at a low level. No distortion is present in this condition.

Figure 6:
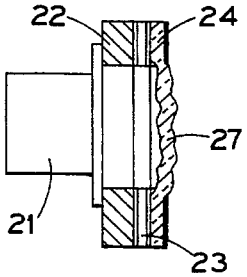
FIG. 6 (PRIOR ART)
FIG. 6 is a side section view of a prior art membrane switch display under a high heat condition showing distortion of the membrane overlay.

FIG. 6 illustrates a side section view of a prior art membrane switch display 20 under a high heat condition. As illustrated in FIG. 6, the prior art display window 27 area distorts and becomes bubbled or wrinkled. This causes a distortion of the display image, thus rendering the prior art membrane switch display 20 unsightly. Thus, the distortion of the prior art display greatly deteriorates the visual information provided by the display 21 to the user.

Figure 7:
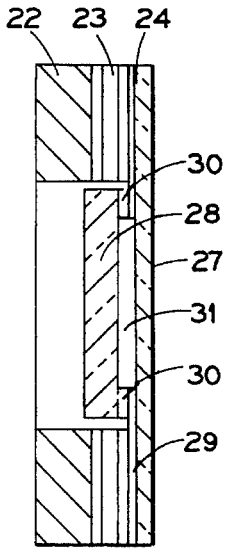
FIG. 7 is an enlarged view of the present invention illustrating the area of adhesion.

FIG. 7 illustrates an enlarged detail of the membrane switch display 20 of the present invention showing the area of adhesion of the clear part 28 to the overlay 24 indicated by the adhesive layer 30. The adhesive layer 30 is preferably only a few thousands of an inch thick. The small inner gap 31 which is also only a few thousands of an inch thick, i.e., approximately equal to the thickness of the adhesive layer 30, is effectively sealed. Thus, the area of the display window 27 cannot draw air into the space between the overlay 24 and the clear part 28, i.e. the air gap 31, and as a result the area of the display window 27 cannot expand outward to cause distortion. The configuration of the present invention overcomes the slight forces of the overlay 24 when it tries to deform. It thus remains flat or distorts very little.

In addition, the center holes 25 and 26 provided in the rigid substructure 22 and the multiple switch layers 23, respectively, allow the user to view the display 21 which is located behind these layers as mentioned above. The overlay 24 itself is solid and has no holes. Also, in an embodiment of the present invention, the overlay 24 portion of the display window 27 for viewing the display 21 is clear or may be tinted. The back side of the overlay 24 is screened or printed with a color or a graphic 29 to provide a clean appearance on the control panel 15. For example, the overlay 24 may be silk-screened. The purpose of the graphic 29 is to cover any extra parts of the display 21 that would otherwise be visible from the front. Essentially, the graphic 29 "masks off" and crops the display 21 so that the display window 27 provides a clear frame for the viewing display 21.

As is apparent from the foregoing specification, the invention is susceptible of being embodied with various alterations and modifications which may differ particularly from those that have been described in the specification. It should be understood that I wish to embody within the scope of the patent warranted hereon, all such modifications as reasonably and properly come within the scope of my contribution to the art.

The embodiments of the invention in which an exclusive property or privilege is claimed are therefore defined as follows:

1. A flat, high temperature membrane switch display window comprising:

a display having a length dimension and a height dimension;

a rigid substructure having a center hole of the approximate dimensions of said display located adjacent to the display;

multiple switch layers having a center hole of the approximate dimensions of said display located adjacent to the rigid substructure;

an overlay having a display window having the approximate dimensions of said display located approximately in the center of the overlay, said overlay further having an interior side and an exterior side wherein the interior side of the overlay is located adjacent to the multiple switch layers; and a rigid clear part affixed to said interior side of said overlay by an adhesive wherein the adhesive is affixed only to a peripheral edge of said clear part.

2. The membrane switch display window according to claim 1, wherein said clear part is constructed of plastic.

3. The membrane switch display window according to claim 1, wherein said clear part is constructed of glass.

4. The membrane switch display window according to claim 1, wherein said adhesive is a few thousands of an inch thick.

5. The membrane switch display window according to claim 1, wherein said adhesive is heat-resistant.

6. The membrane switch display window according to claim 1, wherein said interior side of said display window of said overlay is silk-screened.

7. The membrane switch display window according to claim 1, wherein said interior side of said display window of said overlay has a graphic applied thereto.

8. A flat, high temperature membrane switch display window comprising:

a display;

a rigid substructure with a center aperture located adjacent to the display;

multiple switch layers with a center aperture located adjacent to the rigid substructure;

an overlay with a display window located adjacent to the multiple switch layers; and means for preventing thermal distortion of said overlay wherein said means comprises a clear part and an adhesive layer affixing said clear part to said overlay, said adhesive layer applied only to a periphery of said clear part.

9. The membrane switch display window according to claim 8, wherein said clear part is a glass cube.

10. The membrane switch display window according to claim 8, wherein said clear part is a plastic cube.

11. A flat membrane switch display assembly comprising:

a display device;

a rigid structure having an aperture therethrough through which said display device is visible from a front side thereof the rigid structure located adjacent to the display device;

a flexible, thin, transparent overlay covering said front side of said structure and said aperture;

a rigid transparent member secured relative to said structure and positioned in said aperture closely adjacent to said overlay to produce a minimal volume airspace between said member and said overlay in an area of said aperture; and means for sealing said airspace to prevent a leakage of air into or out of said airspace.

12. A flat membrane switch display assembly according to claim 11, wherein said rigid structure comprises a substructure and multiple switch layers of a membrane switch.

13. A flat membrane switch display assembly according to claim 11, wherein said display device is secured to said rigid structure.

14. A flat membrane switch display assembly according to claim 11, wherein said means for sealing said airspace comprises an adhesive layer between said rigid transparent member and said overlay.

15. A flat membrane switch display assembly according to claim 14, wherein said adhesive layer is limited to a peripheral area of said rigid transparent member.

16. A flat membrane switch display assembly according to claim 11, wherein said rigid transparent member is secured relative to said structure by means of attachment to said overlay.

17. A flat membrane switch display assembly according to claim 11, wherein said rigid transparent member has a thickness less than a thickness of said structure.

* * * * *